US007144489B1

(12) United States Patent
Filas

(10) Patent No.: US 7,144,489 B1
(45) Date of Patent: Dec. 5, 2006

(54) PHOTOCHEMICAL REDUCTION OF FE(III) FOR ELECTROLESS OR ELECTRODEPOSITION OF IRON ALLOYS

(75) Inventor: Robert W. Filas, Basking Ridge, NJ (US)

(73) Assignee: Enpirion, Inc., Bridgewater, NJ (US)

( * ) Notice: Subject to any disclaimer, the term of this patent is extended or adjusted under 35 U.S.C. 154(b) by 502 days.

(21) Appl. No.: 10/278,784

(22) Filed: Oct. 24, 2002

Related U.S. Application Data

(60) Provisional application No. 60/349,195, filed on Oct. 27, 2001.

(51) Int. Cl.

| | |
|---|---|
| ***C25D 21/06*** | (2006.01) |
| ***C25D 5/00*** | (2006.01) |
| ***C25D 3/56*** | (2006.01) |
| ***C25C 1/06*** | (2006.01) |
| ***C07C 1/00*** | (2006.01) |

(52) U.S. Cl. ..... 205/98; 205/91; 205/259; 205/270; 205/587; 204/157.15

(58) Field of Classification Search ..... 204/157.15, 204/157.87, 157.89; 205/91, 255, 259, 270, 205/587, 98, 225

See application file for complete search history.

(56) References Cited

U.S. PATENT DOCUMENTS

| | | | | |
|---|---|---|---|---|
| 3,354,059 A | | 11/1967 | Koretzky | 204/12 |
| 3,795,591 A | | 3/1974 | Clauss et al. | 204/43 T |
| 3,806,429 A | | 4/1974 | Clauss et al. | 204/41 |
| 3,871,973 A | * | 3/1975 | Topham | 205/101 |
| 3,974,044 A | * | 8/1976 | Tremmel | 205/260 |
| 4,129,482 A | | 12/1978 | Lash | 204/43 T |
| 4,384,930 A | | 5/1983 | Eckles | 204/435 |
| 5,421,987 A | | 6/1995 | Tzanavaras et al. | 205/133 |
| 5,472,592 A | | 12/1995 | Lowery | 205/137 |
| 5,670,034 A | | 9/1997 | Lowery | 205/143 |
| 5,683,568 A | | 11/1997 | Harris et al. | 205/259 |
| 5,883,762 A | | 3/1999 | Calhoun et al. | 360/113 |
| 6,344,126 B1 | | 2/2002 | Moore | 205/123 |
| 6,376,063 B1 | | 4/2002 | Rasmussen et al. | 428/328 |
| 6,398,937 B1 | | 6/2002 | Menini et al. | 205/125 |

FOREIGN PATENT DOCUMENTS

DE 3137478 A1 * 4/1983

OTHER PUBLICATIONS

Sima et al., "Photochemistry of Iron(III) Complexes", *Coordination Chemistry Reviews*, vol. 160, pp. 161-189, 1997, no month.

Abrahamson et al., "Photochemical and Spectroscopic Studies of Complexes of Iron(III) With Citric Acid and Other Carboxylic Acids", *Inorganica Chimica Acta*, vol. 226, pp. 117-127, (1994), no month.

Hsieh et al., "Kinetics of Fe(III) Reduction by Ascorbic Acid in Aqueous Solutions", *J. Agric. Food Chem.*, vol. 48, pp. 1569-1573; (2000), no month.

Kuma et al., "Photoreduction of Fe(III) by Hydroxycarboxylic Acids in Seawater", *Wat. Res.*, vol. 29, No. 6, pp. 1559-1569, (1995), no month.

Khan et al., "Metal Ion and Metal Chelate Catalyzed Oxidation of Ascorbic Acid by Molecular Oxygen. I. Cupric and Ferric Ion Catalyzed Oxidation", *Journal of the American Chemical Society*, vol. 89, No. 16, pp. 4176-4185, (1967), no month.

Keypour et al., "Studies on the Reactions of Ferric Iron With Ascorbic Acid. A Study of Solution Chemistry Using Mössbauer Spectroscopy and Stopped-flow Techniques", *Inorganica Chimica Acta.*, vol. 25, pp. 97-106, (1986), no month.

Xu et al., "Kinetics and Mechanism of the Reaction of Aqueous Iron(III) with Ascorbic Acid", *Inorg. Chem.*, vol. 29, pp. 4180-4184, (1990), no month.

* cited by examiner

*Primary Examiner*—Edna Wong
(74) *Attorney, Agent, or Firm*—Morgan Lewis & Bockius

(57) ABSTRACT

A method of photochemically reducing iron(III) species in an iron or iron alloy plating solution by adding an additive to the electroplating solution; contacting the additive with iron(III) species to form an iron(III)-additive species; and irradiating the electroplating solution, wherein the radiation is of sufficient energy to reduce the iron(III) in the iron(III)-additive species to iron(II). The additive comprises hydroxycarboxylic acids and their lactones.

20 Claims, No Drawings

PHOTOCHEMICAL REDUCTION OF FE(III) FOR ELECTROLESS OR ELECTRODEPOSITION OF IRON ALLOYS

This application claims priority under 35 U.S.C. § 119 to U.S. Provisional Patent Application No. 60/349,195 filed on Oct. 27, 2001, the disclosure of which is hereby incorporated by reference in its entirety.

BACKGROUND OF THE INVENTION

1. Field of the Invention

This invention relates to methods of electroplating or electrodepositing a metal, particularly iron and iron alloys, onto a target substrate where the electroplating solution includes an additive, which increases the useful life of the solution. The additive is stable to air and reactive with Fe(III) species to form a Fe(III)-additive species. The electroplating solution is irradiated so that the Fe(III) in the Fe(III)-additive species is reduced to Fe(II), which is then available to be electroplated onto the target substrate. Additives, which appear to be particularly advantageous in the method, include, without limitation, hydroxycarboxylic acids and their lactones. Specifically, sugar acids, such as saccharic or glucaric acid, are especially preferred additives to the electroplating solutions of the present method.

2. Discussion of the Related Art

Electro less and electroplating processes are used to form a wide variety of coatings on various types of substrates. Of particular interest, is the formation of "soft" magnetic alloys on micro-magnetic devices such as magnetic recording heads and thin-film inductors and transformers. Using photolithographic photoresist techniques, desired patterns and shapes may be electroplated onto a target substrate.

An electroplating solution may include a source of metal cations for plating, such as an easily dissociated salt of the metal or metals to be plated, for example, the sulfate or the cyanide, and a buffer to maintain the desired solution pH. A complexing agent to lower the concentration of the free metal ion, and thus slow down the plating process may also be present in a typical electroplating solution. Retarding the plating process prevents a rough or brittle metal plating from forming on the plated substrate.

Electroplating may be utilized to plate films composed of complex alloys, such as CoFeX, NiFeX, and CoNiFeX alloys, where X includes such elements as P, B, S, or Mo. Typically, the X elements are added to the electroplating solution in the form of oxo-acids or salts thereof. See, for instance, U.S. Pat. No. 5,883,762.

The photochemistry of iron compounds, including Fe(III)-hydroxycarboxylic acid complexes, has been studied by various investigators. See, for example, Sima, et al., Coor. Chem. Rev. 160, pp. 161–189 (1997) and Kuma, et al. in Wat. Res., Vol. 29, No. 6, pp. 1559–1569 (1995). Kuma looked at, in particular, the photoreduction to Fe(II) by sunlight of ferric-hydroxycarboxylic acid complexes, including sugar acids, such as glucaric or saccharic acid, in seawater with a typical basic pH of greater than 7.

The use of reducing mono- and di-saccharides to reduce ferric iron in the electroplating bath to ferrous iron is described in U.S. Pat. No. 3,974,044, where in combination with complexing agents, such as hydroxycarboxylic acids, a high iron content plating alloy is obtained. The use of hydroxycarboxylic acids, such as citric acid, as complexing agents to keep both ferrous and ferric ions in solution, or as antioxidants, such as ascorbic acid, to keep ferrous iron in the ferrous state is also described in U.S. Pat. Nos. 3,806,429;3,795,591; and 3,354,059. However, none of those patents disclose irradiating the electroplating solutions to reduce ferric species to ferrous species.

For iron electroplating solutions, formation of ferric or Fe(III)-containing compounds is undesirable since they reduce the plating and current efficiency of the iron electroplating process. The reduction in current efficiency due to the build-up of Fe(III)-containing compounds severely decreases the time that a particular iron electroplating solution may be utilized to electroplate or electrodeposit material onto a target surface. Ferric ions also often precipitate out of the electroplating solution. The desired iron species for plating is ferrous or Fe(II) which is unstable in the presence of dissolved dioxygen ($O_2$) and may be oxidized to ferric ions at the anode.

Some strategies that have been implemented to limit the concentration of Fe(III) in iron electroplating solutions include deoxygenation of the solution by various means, use of a soluble iron anode, and addition of a reducing agent, such as ascorbic acid. Reducing agent usually has to be continuously added to the solution to replace agent oxidized by both Fe(III) and/or oxygen. These oxidation processes also produce oxidation by-products, which may accumulate in the bath and lead to more deleterious effects.

Clearly, there is a need for electroplating methods which decrease the formation of ferric (FeIII) species, preferably to ppm levels or lower, and concurrently increase the concentration of ferrous Fe(II) species available for plating in an electrodeposition solution.

SUMMARY OF THE INVENTION

The present invention meets the above-stated needs and overcomes the drawbacks of current electroplating processes by the addition of an additive to the electrodeposition solution which is insensitive to air, combines with Fe(III) to form a Fe(III)-additive species, and upon irradiation reduces the Fe(III) to Fe(II). The radiation treatment of the Fe(III)-additive species not only reduces the Fe(III) to Fe(II), but also oxidizes the additive to produce oxidation products. The additive lost due to oxidation may be replaced by addition of more additive.

Possible additives according to the invention include, for example, hydroxycarboxylic acids, especially "sugar acids," such as the polyhydroxy-dicarboxylic acids saccharic or glucaric acid, tartaric acid, gluconic acid, and glucuronic acid, and salts thereof. The lactones of the hydroxycarboxylic acids, especially the polyhydroxy-dicarboxylic acids, such as, glucaric acid-1,4-lactone, for example, may also be utilized in the present invention.

The invention may also provide a method of monitoring for the presence and concentration of the Fe(III) species before and after UV-irradiation through spectrophotometric means by observation of a spectrophotometrically active component. Adjustments to the concentration of the additive and/or the intensity of the UV-radiation may then be made based on the spectrophotometric data. For instance, a ferrous-ferric pair, which may be monitored by absorption spectroscopy includes ferrous-ferric sulfate. This procedure may be complicated by the presence of interfering solution components.

The present inventive process may also relate to a method of photochemically reducing iron(III) species in an iron plating solution comprising the steps of adding an additive to the iron plating solution; contacting the additive with iron(III) species to form an iron(III)-additive species; and irradiating the solution. In the present method, the radiation is of sufficient energy to reduce the iron(III) in the iron(III)-additive species to iron(II). The additive is air stable, and combines with iron(III) to form an iron(III)-additive species. It is this iron(III)-additive species which upon exposure to radiation of sufficient energy reduces the iron(III) to iron(II).

Another embodiment of the present method of electroplating iron or iron alloy onto a substrate in an electroplating cell comprises contacting a substrate with an electroplating solution; applying a voltage across an anode and a cathode in contact with the electroplating solution in the electroplating cell; irradiating the electroplating solution; and depositing iron metal or iron alloy onto the substrate. The electroplating solution of the invention comprises iron, which is present as both iron(II) species and iron(III) species, and an additive to substantially limit the concentration of iron(III) species in the electroplating solution. The electroplating solution may also include other plating metals, such as, cobalt, nickel, and other elements to be plated on the target substrate, such as phosphorus, boron, and molybdenum.

A different embodiment of the invention may be a method for decreasing the concentration of iron(III) in an iron electroplating solution by adding an additive to the electroplating solution; contacting the additive with iron(III) to form iron(III)-additive species; and irradiating the electroplating solution to photochemically reduce iron(III) in the iron(III)-additive species to iron(II). Again, the additive utilized does not react with air; and reduces the iron(III) in the iron(III)-additive species to iron(II) upon exposure to radiation of sufficient energy.

The inventive additive comprises at least one member selected from the group consisting of hydroxycarboxylic acids, especially polyhydroxy-dicarboxylic acids, and their lactones. Preferably, the additive comprises at least one member selected from the group consisting of saccharic acid, tartaric acid, gluconic acid, and glucuronic acid, and more particularly preferred is saccharic acid.

Additional features, advantages, and embodiments of the invention may be set forth or apparent from consideration of the following detailed description and claims. Moreover, it is to be understood that both the foregoing summary of the invention and the following detailed description are exemplary and intended to provide further explanation without limiting the scope of the invention as claimed.

DETAILED DESCRIPTION OF THE INVENTION

The present invention is directed to a method of photochemically reducing iron(III) species in an iron plating solution by adding an additive to the iron plating solution; contacting the additive with iron(III) species to form an iron(III)-additive species; and irradiating the solution. The radiation should be of sufficient energy to reduce the iron (III) in the iron(III)-additive species to iron(II).

The radiation treatment also oxidizes the additive to form oxidized additive product. This oxidized additive may be replaced by adding more additive to the iron electroplating solution sufficient to replace the oxidized additive. Thus, the concentration of the additive in the electroplating solution decreases with time as the irradiation process consumes the additive. The initial concentration of the additive to be added to the electroplating solution will vary with the concentration of iron(III) in the electroplating solution. Advantageously the concentration of the additive incorporated into the iron electroplating solution would be just slightly in excess of the amount required to react with the iron(III) species in the electroplating solution.

The additive may be air stable, and combine with iron(III) to form iron(III)-additive species, which upon exposure to radiation of sufficient energy reduces the iron(III) in the iron(III)-additive species to iron(II). Hydroxycarboxylic acids, especially polyhydroxy-dicarboxylic acids, and their lactones are two possible categories of compounds, which may be utilized as the additive. Within those groups, preferred additives are the sugar acids or, such compounds as, for example, saccharic or glucaric acid, tartaric acid, gluconic acid, and glucuronic acid. Among the sugar acids, saccharic acid is particularly preferred, in either its acid form or as a salt, especially the monopotassium salt of saccharic acid. Another preferred additive is glucaric acid-1,4-lactone.

The photochemical reduction process of the present invention by be carried out in an electroplating solution with a pH of is less than about 7, preferably the pH is less than about 5, more preferred is an electroplating solution with a pH of between about 3.5 and about 2.7. Especially preferred is to conduct the process in an electroplating solution having a pH of between about 3.1 and about 2.9.

The UV radiation may be typically at a wavelength of about 365 nm at a power output of about 15 to about 45 $mW/cm^2$ to reduce the Fe(III) in the Fe(III)-additive species to Fe(II) for electroplating solutions having saccharic acid as the additive. The wavelength and power requirements will vary with the additive formulation and concentration of the various other components of the electroplating solution. Coaxially arranged UV-radiation equipment similar to that used to kill bacteria in water treatment facilities may be utilized in the present method.

Optionally, the electroplating solution may contain a component which indicates the concentration of iron(III) and/or iron(II) present in the solution, preferably by a spectrophotometric method. The concentration of the additive may then be controlled in response to the concentration measured by the spectrophotometric method. Examples of such components may include those which undergo a spectrophotometrically measurable change when the iron converts between the ferrous and the ferric states. Depending on the exact formulation of the iron electroplating solution, the measurement of the Fe(III) species of interest may be difficult due to interferences from other components in the solution. Interfering components may include breakdown or degradation products of initial solution components.

The electroplating solution may also include various components to facilitate the plating process and produce a desirable coating, such as, stress reducing agents, complexing agents, supporting electrolytes, brighteners, buffers, and so forth. Such additional components would be known to one of skill in the art.

The present method of electroplating iron or an iron alloy onto a substrate may be conducted in a standard electroplating cell with an anode and a cathode immersed in the electroplating solution with the target substrate also positioned in the electroplating cell. To further limit the concentration of the ferric species, the solution should be degassed of oxygen by any conventional means. A soluble iron anode may be used in place of an insoluble anode to further minimize Fe(II) oxidation. Known systems for electroplating semiconductor-based substrates are described in U.S. Pat. Nos. 6,344,126; 5,833,820; 5,670,034; 5,472,592; and 5,421,987, for instance.

Preferably, the electrochemical cell would also have means to irradiate the solution with UV at a sufficiently high power level. A UV-transparent window through which a UV source could irradiate the electroplating solution could be conveniently located on the plating cell. Alternatively, the electroplating solution could flow, or be pumped, through a UV-transparent tube equipped with coaxial UV sources. A possible source is the Model B 100 AP Ultraviolet lamp (made by UVP of Upland, Calif.) with a wavelength of about 365 nm at a power output level of about 15 to about 45 $mW/cm^2$. Any number of the commercially available UV sources are applicable to the present invention.

The target substrate may be composed of any suitable electroplating or electrodeposition coating material, such as, for instance, metallic, plastic, or semiconductor. The target substrate may be of any form, shape, or size and may be subjected to a coating pretreatment. The present inventive method is not limited in application to any specific substrate material or substrate condition.

Example 1

The head for a magnetic recording device is electroplated in the following manner: A standard electroplating cell with provision to permit UV irradiation of the electroplating solution and an iron anode is used. The electroplating solution contains iron sulfate (as a source of iron ions), monopotassium salt of saccharic acid, a buffer, cobalt sulfate, sodium hypophosphite, and water at a solution iron concentration of about 1 M. The pH of the electroplating solution is preferably controlled to about 3.

The solution is continuously irradiated by 365 nm wavelength light at a power of about 15 $mW/cm^2$ sufficient to reduce the level of iron(III) sulfate in solution. The concentration of iron(III) sulfate is measured by absorption spectroscopy over a wavelength range of about 300 to about 550 nm. For example, the wavelength at which the absorption in a 1 cm cuvette is equal to 1.00 falls from over 550 nm to below 300 nm after irradiation.

A current density of about −5 $mA/cm^2$ is applied across the cathode and anode.

Comparative Example 2

The head for a magnetic recording device is electroplated similarly to Example 1 without the continuous irradiation of the electroplating solution.

A current density of about −5 mA/cm2 is applied across the cathode and anode.

Comparative Example 3

The head for a magnetic recording device is electroplated similarly to Example 1 except that the solution contains ascorbic acid in place of saccharic acid and there is no irradiation of the electroplating solution. A current density of about −5 mA/cm2 is applied across the cathode and anode.

The current efficiency as measured by mass for Example 1 will not deteriorate as rapidly and will be more long-lived than Comparative Examples 2 and 3.

Although the foregoing description is directed to the preferred embodiments of the invention, it is noted that other variations and modifications will be apparent to those skilled in the art, and may be made without departing from the spirit or scope of the invention. The disclosures of all patents referenced herein are hereby incorporated by reference in their entireties for all purposes.

I claim:

1. A method of photochemically reducing iron(III) species in an iron or iron alloy electroplating solution comprising:

adding an additive to the electroplating solution;

contacting the additive with an iron(III) species to form an iron(III)-additive species; and irradiating the electroplating solution, wherein the radiation is of sufficient energy to reduce the iron(III) in the iron(III)-additive species to iron(II), wherein the additive is saccharic acid or a salt or lactone thereof.

2. The method according to claim 1, wherein irradiating the electroplating solution oxidizes the additive.

3. The method according to claim 2, further comprising adding the additive to the electroplating solution to replace the oxidized additive.

4. The method according to claim 1, wherein the additive is air stable.

5. The method according to claim 1, wherein the pH of the electroplating solution is less than about 7.

6. The method according to claim 5, wherein the pH of the electroplating solution is less than about 5.

7. The method according to claim 6, wherein the pH of the electroplating solution is less than about 3.5.

8. The method according to claim 7, wherein the pH of the electroplating solution is less than about 3.1.

9. The method according to claim 1, wherein the salt is a monopotassium salt of saccharic acid.

10. A method of electroplating iron or an iron alloy onto a substrate in an electroplating cell comprising:

contacting a substrate with an electroplating solution, wherein the electroplating solution comprises:

iron present as iron(II) and iron(III) species, and an additive to substantially limit the concentration of the iron(III) species in the electroplating solution, wherein the additive is saccharic acid or a salt or lactone thereof;

applying a voltage across an anode and a cathode in contact with the electroplating solution in an electroplating cell;

irradiating the electroplating solution; and depositing the iron or iron alloy onto the substrate.

11. The method according to claim 10, wherein the concentration of the iron(III) species is substantially limited by its contact with the additive to form an iron(III)-additive species.

12. The method according to claim 11, wherein the irradiating comprises exposing the electroplating solution to radiation of sufficient energy to reduce the iron(III) present in the iron(III)-additive species to iron(II).

13. The method according to claim 12, wherein the irradiating oxidizes the additive.

14. The method according to claim 13, further comprising a step of adding the additive to the electroplating solution to replace the oxidized additive.

15. The method according to claim 10, wherein the additive is air stable.

16. The method according to claim 10, wherein the pH of the electroplating solution is less than about 7.

17. The method according to claim 16, wherein the pH of the electroplating solution is less than about 5.

18. The method according to claim 17, wherein the pH of the electroplating solution is less than about 3.5.

19. The method according to claim 18, wherein the pH of the electroplating solution is less than about 3.1.

20. The method according to claim 10, wherein the salt is a monopotassium salt of saccharic acid.

* * * * *